US005138784A

United States Patent [19]

Niwa

[11] Patent Number: 5,138,784

[45] Date of Patent: Aug. 18, 1992

[54] MARKING COLLAR

[76] Inventor: Joseph T. R. Niwa, Main Road South, Pungarehu, South Taranaki, New Zealand

[21] Appl. No.: 804,461

[22] Filed: Dec. 4, 1991

Related U.S. Application Data

[63] Continuation of Ser. No. 625,900, Dec. 10, 1990, abandoned.

[30] Foreign Application Priority Data

Dec. 15, 1989 [NZ] New Zealand ..... 231809

[51] Int. Cl.[5] ..... G09F 3/00

[52] U.S. Cl. ..... 40/665; 40/316

[58] Field of Search ..... 40/316, 645, 306, 649, 40/665, 666; 24/22, 23 R, 25, 268

[56] References Cited

U.S. PATENT DOCUMENTS

| | | | |
|---|---|---|---|
| 1,960,748 | 5/1934 | Meunier | 40/668 |
| 4,246,712 | 1/1981 | Vander Wall | 40/316 |
| 4,268,986 | 5/1981 | Piana | 40/316 |
| 4,844,000 | 7/1989 | Clement | 116/205 |
| 4,892,280 | 1/1990 | McGugan et al. | 248/230 |

FOREIGN PATENT DOCUMENTS

| | | | |
|---|---|---|---|
| 0064708 | 11/1982 | European Pat. Off. | 40/316 |
| 2009871 | 9/1971 | Fed. Rep. of Germany | 40/316 |
| 464609 | 3/1914 | France | 24/268 |
| 989878 | 4/1965 | United Kingdom | 40/316 |

*Primary Examiner*—William A. Cuchlinski, Jr.
*Assistant Examiner*—W. Morris Worth

[57] ABSTRACT

A pipe identification system using marking collars which indicate the contents of a pipe and/or the direction of fluid flow. The pipe contents may be indicated by the color of the marking collar or by symbols marked on the collar. Fluid flow direction may be indicated by arrows which may be raised and colored a different color to the base of the marking collar. The marking collars may be easily attached or removed and are suitable for rapidly marking pipes during a hazard situation.

7 Claims, 4 Drawing Sheets

MARKING COLLAR

Figure 1:
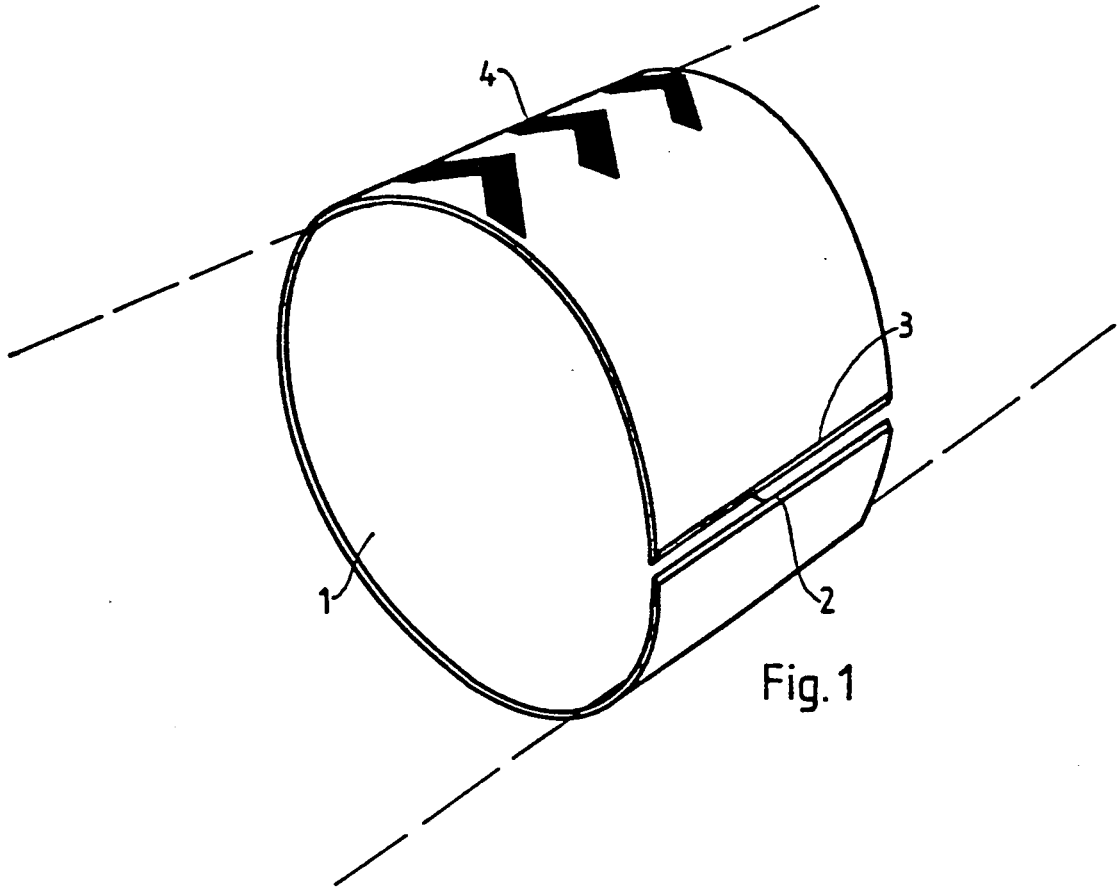

This application is a continuation of application Ser. No. 625,900, filed Dec. 10, 1990 now abandoned.

The present invention relates to a marking collar and methods of using the same. More particularly, but not exclusively, the present invention relates to a marking collar suitable for use in marking pipes.

For safety reasons it is necessary to mark pipes so as to indicate what the pipes contain and sometimes also the direction of flow. To the present time several systems of colour coding have been used to indicate the substances flowing within a pipe. Markings such as arrows have also been used to indicate the direction of flow etc.

It is particularly important that pipes are clearly marked so that in an emergency a pipe may be identified quickly and remedial action taken. In some cases it is also desirable that pipes be marked quickly to indicate there is a hazard on that particular pipe.

To the present time several methods of colour coding pipes have been used around the world and any of these coding methods may be used with the present invention. Common symbols (such as arrows to indicate the direction of flow) have also been utilised and may be used with the present invention.

To the present time various methods of marking pipes and cables have been used, but all have had their drawbacks. One method of marking pipes has been to hand paint a band of colour around a pipe to indicate the substance flowing in the pipe and stencilling on the coloured portion symbols indicating fluid flow direction etc. This method has the drawbacks that it is very time consuming, expensive (due to the time, disposable paints, brushes, rollers and thinners required), the legible life of the markings are low (due to ultra violet fading, chipping and other deterioration) and the marking is lost completely when the pipe line is repainted or replaced requiring reapplication of the marking.

Another method used for marking pipes is to stencil markings only onto the pipe with no colour coding. As well as the above disadvantages this system is also a safety risk as the lack of colour coding makes it more difficult to rapidly identify a required pipe.

Another method of marking pipes has been to apply coloured adhesive tapes around a pipe line. As well as some of the above disadvantages this method has the disadvantage that due to peeling and lifting the life expectancy of such markings is short.

U.S. Pat. No. 4,844,000 discloses a clamp which may be connected to a fire hose having a plurality of fingers to indicate the direction to the source of connection.

This patent does not disclose a clamp or system suitable to indicate the contents of a plurality of pipes carrying different substances. The clamp is designed to indicate the direction to the source of a hose by "feel" rather than by visual means.

U.S. Pat. No. 4,246,712 discloses a pipe marking means in which a rigid plate having indicia thereon is secured to a pipe by straps. The method of attachment is slow as the straps must be individually fastened. Furthermore the marking means is unsuitable in an emergency situation due to the time taken to secure a marker.

It is an object of the present invention to provide a method of marking pipes and a marking collar which overcome the abovementioned disadvantages or to at least provide the public with a useful choice.

Further objects of the present invention will become apparent from the following description.

According to the present invention there is provided a marking collar for indicating the contents of a pipe, said marking collar comprising a flexible substantially "C" shaped band having ends which can be forced apart to allow the collar to be placed over a pipe which when released spring towards each other to clamp said collar onto said pipe, wherein the band is a given colour to indicate the contents of a pipe or wherein symbols are provided on the band to indicate the contents of a pipe.

According to a further aspect of the present invention there is provided a method of marking a plurality of pipes to indicate the contents of the pipes, said method comprising applying a plurality of marking collars as claimed in claim 1 of a variety of colours to a plurality of pipes, each colour corresponding to an individual substance.

According to a further aspect of the present invention there is provided a marking collar comprising a substantially "C" shaped flexible band having protrusions extending from either end, said protrusions being engageable with one or more clips to hold the ends together to secure said marking collar to a pipe, said clips being coloured or having indicia indicating the contents of said pipe.

According to a further aspect of the present invention there is provided a marking collar comprising two semi-circular bands having protrusions at either end, said simi-circular bands being secureable to a pipe by clips which engage with said protrusions to hold the ends of said semi-circular bands together, wherein the contents of said pipe are indicated by clips of different colours or symbols on said clips.

According to a further aspect of the present invention there is provided a marking collar comprising two semi-circular bands hingeably connected and having protrusions at the ends remote from the hinge connection, said marking collar being securable to a pipe by a clip which engages with the protrusions to secure the ends of said semi-circular bands together.

Figure 5:
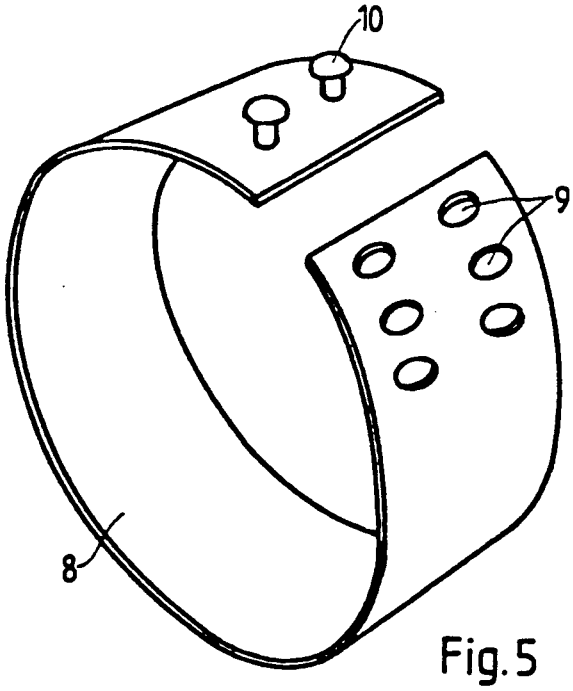
Figure 4:
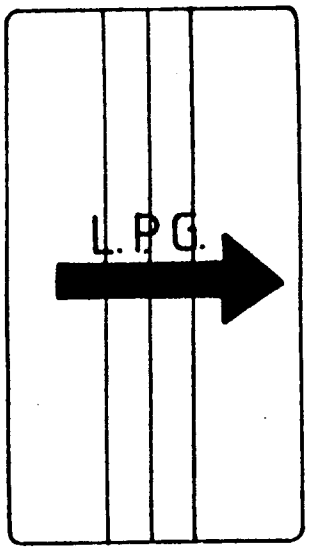
Figure 3:
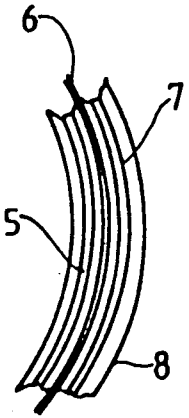
Figure 2:
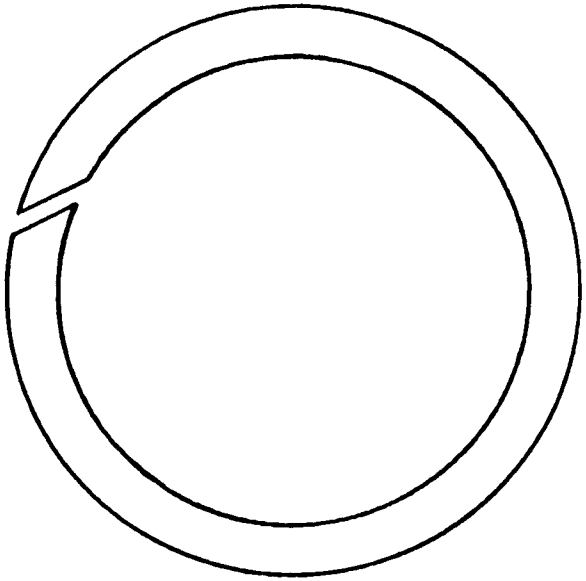
Figure 7:
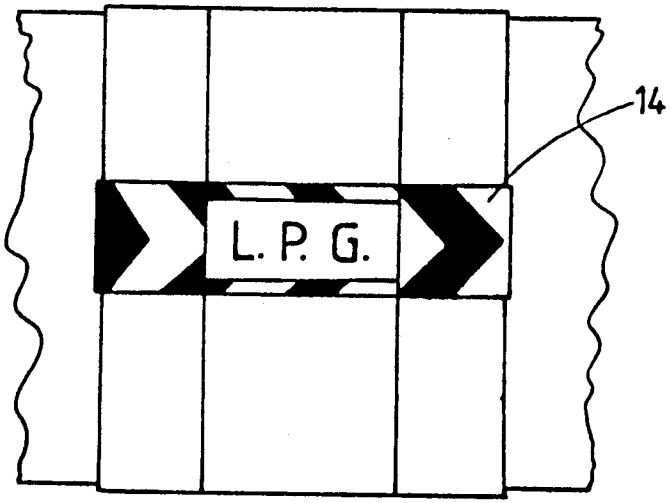
Figure 6:
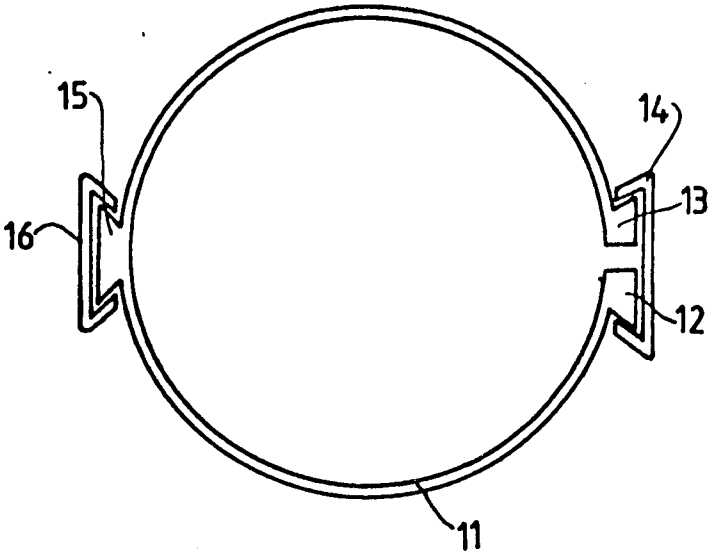

Further aspects of this invention, which should be considered in all its novel aspects, will become apparent from the following description given by way of example of possible embodiments thereof and in which reference is made to the accompanying drawings wherein:

FIG. 1: shows a marking collar according to a first embodiment of the present invention;

FIG. 2: shows an end-on view of a marking collar according to the first embodiment;

FIG. 3: shows a cross-sectional view of the construction of a collar according to the first embodiment;

FIG. 4: shows a collar according to the first embodiment having an alternative marking;

FIG. 5: shows a collar according to a second embodiment of the present invention;

FIG. 6: shows a marking collar according to a third embodiment of the present invention in cross-section;

FIG. 7: shows a view of a collar according to the third embodiment when engaged with a pipe.

Figure 8:
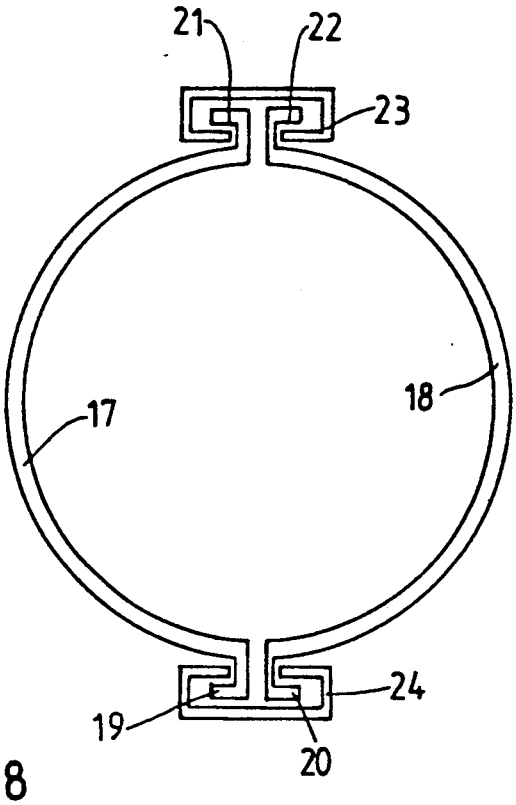
Figure 9:
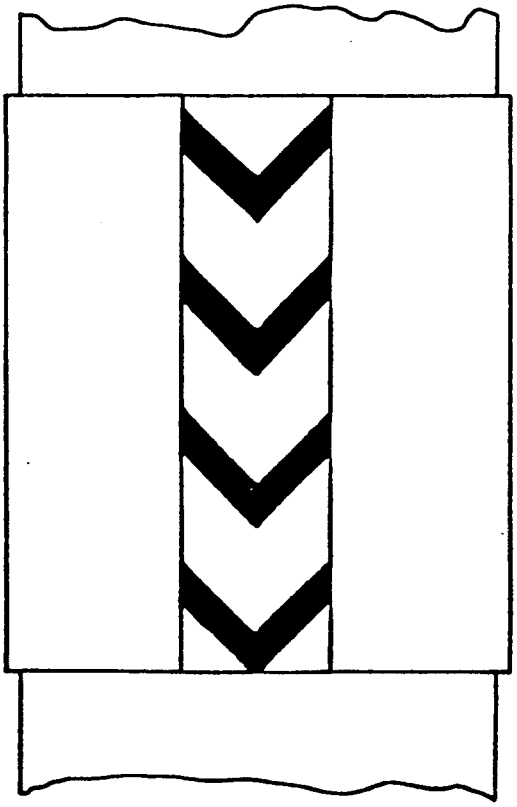

FIG. 8: shows a cross-sectional view of a collar according to a fourth embodiment of the present invention;

FIG. 9: shows a collar according to the fourth embodiment when attached to a pipe.

Referring now to FIG. 1, a marking collar according to a first embodiment of the present invention is shown.

The collar is a flexible substantially "C" shaped band having ends 2 and 3. The collar is formed of a flexible material so that ends 2 and 3 may be pulled apart a distance greater than the diameter of a pipe to enable the collar to be fitted onto a pipe. The material must have sufficient memory to return to its original shape around the pipe so the ends spring together to clamp the collar to the pipe. The diameter of the collar before attachment to a pipe will preferably be less than the diameter of the pipe to which it is to be connected so it is in a sprung state.

These marking collars are easily applied as an operator merely needs to pull apart ends 2 and 3 to a sufficient degree to enable the collar to be fitted over a pipe where upon release, due to the memory in the material, the collar will return to it's original shape and be secured to the pipe. If desired the collars may be secured to the pipes with an adhesive or silicon grease.

The collars may be dyed a variety of colours indicating the contents of a pipe. Markings 4 may also be provided on the collar to indicate direction flow of fluid etc. Any particular required marking system may be used with the present invention.

The collars of the present invention may be formed by firstly forming a tube by protrusion, extrusion, cylindrical or centrifugal spinning, lathing, injection moulding, drop moulding, singular or multiple moulding, hinged moulding or hand laminating and then cutting a section of tube of the required dimensions and then severing the tube in the general direction of the axis of the pipe. Alternatively a longitudinal cut may be made first and crosswise cuts effected to produce collars of the required width. Materials such as fibreglass, kevlar, carbon fibre or plastics may be suitable. It is to be appreciated that the collars may be of any cross-sectional shape complimentary to the pipe to which they will be engaged.

In one embodiment of the present invention the collars will be formed of fibreglass to which may be added colour pigments, fire retardants, ultra violet protection and wax in styrene depending upon the environment requirements.

The collars may also be formed by injection moulding of plastics materials.

Referring now to FIG. 3, a possible cross-sectional construction is shown. The collar is seen to consist of internal skin layers 5, tissue print layer 6, laminated glass fibre layer 7 and external skin 8. The collars may be constructed by a multi-layer laminate process with layer polarisation and multi-layer pigmentation to ensure long life colour fixing against ultra violet exposure and for robustness and durability.

According to one process of manufacture a stainless steel tube of the desired dimensions is supplied. The stainless steel tube will preferably be of a smaller diameter than the pipe to which the collar is to be fitted so that a tight fit is ensured. The stainless steel tube is first waxed with a release agent. Fibreglass weave is then wound onto the mould whilst resin is brushed and squeegeed during rotation. The number of layers applied depends upon the elasticity required for a given pipe size. Using a 150 mm pipe six layers give the collar the correct elasticity.

A filler coat is then applied using the same resin used in the previous stage. This is then left to cure for 24 hours whereafter the surface is sanded and markings may be added. The markings may be added by screen printing, stamping, etching etc. A final coat may then be applied which includes fire retardants and an ultra violet shield. 24 hours after this coat has been applied the fibreglass tube formed is cut along its length and the collars are cut to the desired widths and removed from the mould.

A wide range of resins may be used in conjunction with a wide range of additives such as kevlar, carbon fibre, one pot resins or two pot resins etc.

Referring to FIG. 4, an alternative form of marking is shown in which the product flowing within a pipe may be identified by lettering as well as the direction of flow being indicated by an arrow. Such markings may be used instead of colour coding or in conjunction with colour coding depending upon user requirements. The markings may be raised and a different colour to the base colour may be applied to the raised portions.

Referring now to FIG. 5, a second embodiment of the present invention is shown. In this embodiment a strip 8 is provided with a plurality of apertures 9 in one end thereof and catches 10 on the other end thereof. In this embodiment the strip 8 will preferably be formed of an elastic material so that when the strip is wrapped around a pipe the strip may be stretched so that one set of apertures 9 aligns with catches 10 to fasten the strip to a pipe whilst keeping the strip under tension. In this way the strip may be securely fastened to a pipe. Colour codings and markings may be applied to strips 8 according to any desired system. In applications where there is a fire risk strip 8 should be made of a fire resistant material such as silicon rubber etc. In applications where there are not fire risks strip 8 may be formed of any suitable elastic material including plastics. It is to be appreciated that the fastening means of apertures 9 and catches 10 may be replaced by any suitable fastening means such as domes, velcro etc.

Referring now to FIG. 6, a collar according to a third embodiment of the present invention is shown. Body 11 is provided with lips 12 and 13 which may be secured together by a clip 14. In use the ends of collar 11 may be pulled apart to a diameter greater than that of the pipe to which it is to be fitted and then placed over the pipe whereupon it may be released to resume its normal shape. The ends of the collar may then be forced together and clip 14 slideably engaged to hold the ends together via lips 12 and 13. An adhesive or compressible layer may be placed between the collar and the pipe.

The collar is shown in FIG. 7 when attached to a pipe. Clip 14 is seen to be provided with markings thereon indicating the fluid flow direction and the fluid within the pipe. A protrusion 15 may be provided on the collar shown in FIG. 6 to which a second clip 16 may be applied so that the markings are visible from either side of the pipe. When the markings of a pipe are to be changed all that needs to be changed are the clips 14 and 16 whilst the body portion 11 may be reused. As clips 14 may be formed of stamped metal, extruded aluminium etc they may be cheaply produced and thus the cost of changing the marking system is relatively low. In some systems the body 11 may be a unique colour corresponding to the contents of the pipe it is to mark.

According to another embodiment a plurality of coloured clips may be used instead of a single clip 14. The contents of a pipe may be indicated by a unique combination of colours or sequence of colours.

Clips 14 and 16 may come in a variety of sizes to accommodate minor variations in the sizes of pipes. Alternatively clips of adjustable length may be provided. Such a clip may consist of two sliding halves with lengthwise grooves which are connected by a bolt and wing nut.

The clips may also be formed of a spring steel in which case they may be forced over the lips and protrusion and spring back to retain the ends together, rather than being slideably engaged.

Referring now to FIG. 8, a collar according to an alternative embodiment is shown. The collar is seen to be formed of a first semi-circular portion 17 and a second semi-circular portion 18. Each semi-circular portion is seen to be provided with protrusions 19, 20, 21 and 22 at either end thereof. Clips 23 and 24 are slideably engageable with the protrusions 19, 20, 21 and 22 to clamp the two semi-circular portions 17 and 18 together when they are placed around a pipe.

In this embodiment the semi-circular portions 17 and 18 do not need to be flexible and may be formed of rigid materials such as metals. Clips 23 and 24 may likewise be formed of metals. Accordingly, these collars may find applications in areas where extreme fire safety is required or where flexible materials would be unsuitable.

Clips 23 and 24 may be provided with markings thereon as in the previous embodiment and likewise these clips may be changed when different markings are required.

In another embodiment ends 19 and 20 may be connected by a hinge so that only clip 23 need be applied to secure the collar to a pipe.

The collars of the present invention may be formed by injection moulding or extrusion or some other suitable process. They may be formed of plastics, metals or other suitable materials. The plastics may be fire resistent varieties.

The present invention is seen to have many advantages over the prior art. The marking system of the present invention may generate savings in that the marking collars are easily applied, reducing the labour required for marking pipes, and the markings are long lasting with the collars being reusable. A major advantage of the present invention is the improved safety in that markings of the present invention remain legible for a long time (due to the sturdy construction and ultra violet protection) and thus enable pipes to be identified quickly in an emergency. Further, when marking of pipes is required quickly in an emergency situation the collars of the present invention may be quickly applied. Further, the present invention provides a convenient and flexible system wherein pipe markings may be quickly and easily changed.

Where in the aforegoing description reference has been made to specific components or integers of the invention having known equivalents then such equivalents are herein incorporated as if individually set forth.

Although this invention has been described by way of example and with reference to possible embodiments thereof it is to be understood that modifications or improvements may be made thereto without departing from the scope of the invention as defined in the appended claims.

What is claimed is:

1. A marking collar comprising a substantially "C" shaped flexible band having lips extending outwardly from either end, the lips being engageable with one or more clips to hold the ends of the band together to secure the marking collar to a pipe, the band being provided with an outwardly extending protrusion midway along said band adapted to engage with one or more clips, wherein the clips carry markings to indicate the contents of a pipe.

2. A marking collar as claimed in claim 1 wherein edges of the lips and protrusions which engage with the clips diverge outwardly from the band.

3. A marking collar as claimed in claim 1 wherein the clips consist of substantially rectangular body portions having markings thereon, and wherein the longitudinal edges are bent inwardly to form acute angles with the body portions.

4. A marking collar as claimed in claim 3 wherein the markings are in the form of symbols.

5. A marking collar as claimed in claim 3 wherein the markings consist of colours applied to the rectangular body of the clips.

6. A marking collar as claimed in claim 3 wherein the markings consist of colours applied to the rectangular body of the clips in combination with symbols.

7. A marking collar as claimed in claim 1 wherein a plurality of clips are provided on the protrusion and the lips.

* * * * *